US010745238B2

(12) United States Patent
Krishnamurthy et al.

(10) Patent No.: US 10,745,238 B2
(45) Date of Patent: Aug. 18, 2020

(54) POWER DISTRIBUTION FOR MULTICAR, ROPELESS ELEVATOR SYSTEM

(71) Applicant: Otis Elevator Company, Farmington, CT (US)

(72) Inventors: Shashank Krishnamurthy, Glastonbury, CT (US); Daryl J. Marvin, Farmington, CT (US); Luis Arnedo, Cary, NC (US)

(73) Assignee: OTIS ELEVATOR COMPANY, Farmington, CT (US)

( * ) Notice: Subject to any disclaimer, the term of this patent is extended or adjusted under 35 U.S.C. 154(b) by 546 days.

(21) Appl. No.: 15/542,153

(22) PCT Filed: Jan. 19, 2016

(86) PCT No.: PCT/US2016/013831
§ 371 (c)(1),
(2) Date: Jul. 7, 2017

(87) PCT Pub. No.: WO2016/118466
PCT Pub. Date: Jul. 28, 2016

(65) Prior Publication Data

US 2018/0334356 A1 Nov. 22, 2018

Related U.S. Application Data

(60) Provisional application No. 62/105,989, filed on Jan. 21, 2015.

(51) Int. Cl.
*B66B 11/04* (2006.01)
*B66B 1/30* (2006.01)
(Continued)

(52) U.S. Cl.
CPC ..... *B66B 1/24* (2013.01); *B66B 1/34* (2013.01); *B66B 9/02* (2013.01); *B66B 11/0407* (2013.01)

(58) Field of Classification Search
USPC ..... 187/290
See application file for complete search history.

(56) References Cited

U.S. PATENT DOCUMENTS 5,090,516 A * 2/1992 Gsrinaski ..... H02K 41/025 187/251
5,203,432 A * 4/1993 Grinaski ..... B66B 11/0055 187/251
(Continued)

FOREIGN PATENT DOCUMENTS

CN 1053331 A 7/1991
CN 1625523 A 6/2005
(Continued)

OTHER PUBLICATIONS

International Search Report, International Application No. PCT/US2016/013831, dated May 4, 2016, European Patent Office, International Search Report 5 pages.
(Continued)

*Primary Examiner* — Christopher Uhlir
(74) *Attorney, Agent, or Firm* — Cantor Colburn LLP

(57) ABSTRACT

An elevator power distribution system includes an elevator car (114; 214; 314; 414; 514) configured to travel in a lane (113, 115, 117; 213; 313, 315, 317; 413, 415, 417; 513, 515, 517) of an elevator shaft (111) and a linear propulsion system configured to impart force to the elevator car. The linear propulsion system includes a first portion (216), mounted in the lane and a second portion (218) mounted to the elevator car configured to coact with the first portion (216) to impart movement to the elevator car. A plurality of electrical buses (371, 372, 373, 374; 471, 472, 473, 474; 571, 572, 573, 574) are disposed within the lane and configured to provide power to the first portion, a rectifier (361*a*, 362*a*, 363*a*, 364*a*, 361*b*, 362*b*, 363*b*, 364*b*, 361*c*, 362*c*, 363*c*, 364*c*; 461*a*, 462*a*, 463*a*, 464*a*, 461*b*, 462*b*,
(Continued)

463*b*, 464*b*, 461*c*, 462*c*, 463*c*, 464*c*; 561*a*, 562*a*, 563*a*, 564*a*, 561*b*, 562*b*, 563*b*, 564*b*, 561*c*, 562*c*, 563*c*, 564*c*) is electrically connected to each of the plurality of buses and configured to convert power provided between the respective bus and a grid (302; 402; 502), and a battery backup (381*a*, 382*a*, 383*a*, 384*a*, 381*b*, 382*b*, 383*b*, 384*b*, 381*c*, 382*c*, 383*c*, 384*c*; 481*a*, 482*a*, 483*a*, 484*a*, 481*b*, 482*b*, 483*b*, 484*b*, 481*c*, 482*c*, 483*c*, 484*c*; 585*a*, 585*b*, 585*c*) is electrically connected with the rectifier and configured to transfer power to or receive power from the rectifier.

19 Claims, 5 Drawing Sheets

(51) Int. Cl.

| | |
|---|---|
| ***B66B 1/24*** | (2006.01) |
| ***B66B 9/02*** | (2006.01) |
| ***B66B 1/34*** | (2006.01) |

(56) References Cited

U.S. PATENT DOCUMENTS

| | | | | |
|---|---|---|---|---|
| 9,868,515 | B2 * | 1/2018 | Nakagawa | B64D 41/00 |
| 2018/0345797 | A1 * | 12/2018 | Marzano | B60L 7/28 |

FOREIGN PATENT DOCUMENTS

| | | | |
|---|---|---|---|
| CN | 2873722 | Y | 2/2007 |
| CN | 101282898 | A | 10/2008 |
| CN | 101670959 | A | 3/2010 |
| CN | 101875465 | A | 11/2010 |
| JP | H03142369 | A | 6/1991 |
| JP | 2010064864 | A | 3/2010 |
| WO | 2007044000 | A1 | 4/2007 |

OTHER PUBLICATIONS

Written Opinion, International Application No. PCT/US2016/013831, dated May 4, 2016, European Patent Office, Written Opinion 6 pages.

* cited by examiner

POWER DISTRIBUTION FOR MULTICAR, ROPELESS ELEVATOR SYSTEM

CROSS REFERENCE TO RELATED APPLICATIONS

This is a U.S. National Stage of Application No. PCT/US2016/013831, filed on Jan. 19, 2016, which claims the benefit of U.S. Provisional Patent Application No. 62/105,989, filed on Jan. 21, 2015, the disclosures of which are incorporated herein by reference.

BACKGROUND OF THE INVENTION

The subject matter disclosed herein generally relates to the field of elevators, and more particularly to power distribution for a multicar, ropeless elevator system.

Ropeless elevator systems, also referred to as self-propelled elevator systems, are useful in certain applications (e.g., high rise buildings) where the mass of the ropes for a roped system is prohibitive and there is a desire for multiple elevator cars to travel in a single hoistway, elevator shaft, or lane. There exist ropeless elevator systems in which a first lane is designated for upward traveling elevator cars and a second lane is designated for downward traveling elevator cars. A transfer station at each end of the lane is used to move cars horizontally between the first lane and second lane.

BRIEF DESCRIPTION OF THE INVENTION

According to one embodiment, an elevator power distribution system is provided. The system includes an elevator car configured to travel in a lane of an elevator shaft and a linear propulsion system configured to impart force to the elevator car. The linear propulsion system includes a first portion mounted in the lane of the elevator shaft and a second portion mounted to the elevator car configured to coact with the first portion to impart movement to the elevator car. A plurality of electrical buses are disposed within the lane and configured to provide power to the first portion of the linear propulsion system, a rectifier is electrically connected to each of the plurality of buses and configured to convert power provided between the respective bus and a grid, and a battery backup is electrically connected with the rectifier and configured to transfer power to or receive power from the rectifier.

In addition to one or more of the features described above, or as an alternative, further embodiments may include, wherein each of the plurality of buses is a continuous, uninterrupted power line extending the length of the lane.

In addition to one or more of the features described above, or as an alternative, further embodiments may include, wherein a plurality of pairs of rectifiers and battery backups are provided in electrical communication with each of the plurality of buses.

In addition to one or more of the features described above, or as an alternative, further embodiments may include one or more circuit breakers configured to split the continuous, uninterrupted power line into two or more zones.

In addition to one or more of the features described above, or as an alternative, further embodiments may include, wherein a single battery backup is configured in electrical communication with a plurality of rectifiers.

In addition to one or more of the features described above, or as an alternative, further embodiments may include, wherein each of the plurality of buses is composed of a plurality of zones.

In addition to one or more of the features described above, or as an alternative, further embodiments may include, wherein a plurality of pairs of rectifiers and battery backups are provided in electrical communication with each of the zones of the plurality of buses.

In addition to one or more of the features described above, or as an alternative, further embodiments may include, wherein each zone of the plurality of buses includes a single battery backup and a plurality of rectifiers in electrical communication therewith.

In addition to one or more of the features described above, or as an alternative, further embodiments may include one or more additional elevator cars, the power distribution system configured to supply power to and receive power from at least one of the elevator car and the one or more additional elevator cars.

In addition to one or more of the features described above, or as an alternative, further embodiments may include, wherein the plurality of buses is at least three buses.

According to another embodiment, a method of power distribution is provided. The method includes providing a plurality of buses configured to provide power to a linear propulsion system, converting power (i) received from a grid and providing it to at least one of the plurality of buses and (ii) received from at least one of the plurality of buses and providing to at least one of the grid and a battery backup, and transferring power from one of the plurality of buses to another of the plurality of buses to supply power thereto.

In addition to one or more of the features described above, or as an alternative, further embodiments may include, wherein each of the plurality of buses is a continuous, uninterrupted power line extending the length of the lane.

In addition to one or more of the features described above, or as an alternative, further embodiments may include, wherein a plurality of pairs of rectifiers and battery backups are provided in electrical communication with each of the plurality of buses.

In addition to one or more of the features described above, or as an alternative, further embodiments may include splitting the continuous, uninterrupted power line into two or more zones.

In addition to one or more of the features described above, or as an alternative, further embodiments may include, wherein each of the plurality of buses is composed of a plurality of zones.

In addition to one or more of the features described above, or as an alternative, further embodiments may include, wherein a plurality of pairs of rectifiers and battery backups are provided in electrical communication with each of the zones of the plurality of buses.

In addition to one or more of the features described above, or as an alternative, further embodiments may include, wherein each zone of the plurality of buses includes a single battery backup and a plurality of rectifiers in electrical communication therewith.

Technical features of the invention include providing a distributed power supply to a multicar, ropeless elevator system. Further technical features of embodiments of the invention include an efficient power distribution system with redundant power supply and control. Further technical features of embodiments of the invention include providing a battery backup system that enables self-sufficiency of a power supply system. Further technical features of embodiments of the invention include a redundant, distributive, and regenerative power distribution system.

BRIEF DESCRIPTION OF THE DRAWINGS

The subject matter which is regarded as the invention is particularly pointed out and distinctly claimed in the claims at the conclusion of the specification. The foregoing and other features and advantages of the invention are apparent from the following detailed description taken in conjunction with the accompanying drawings in which:

DETAILED DESCRIPTION OF THE INVENTION

Figure 1:
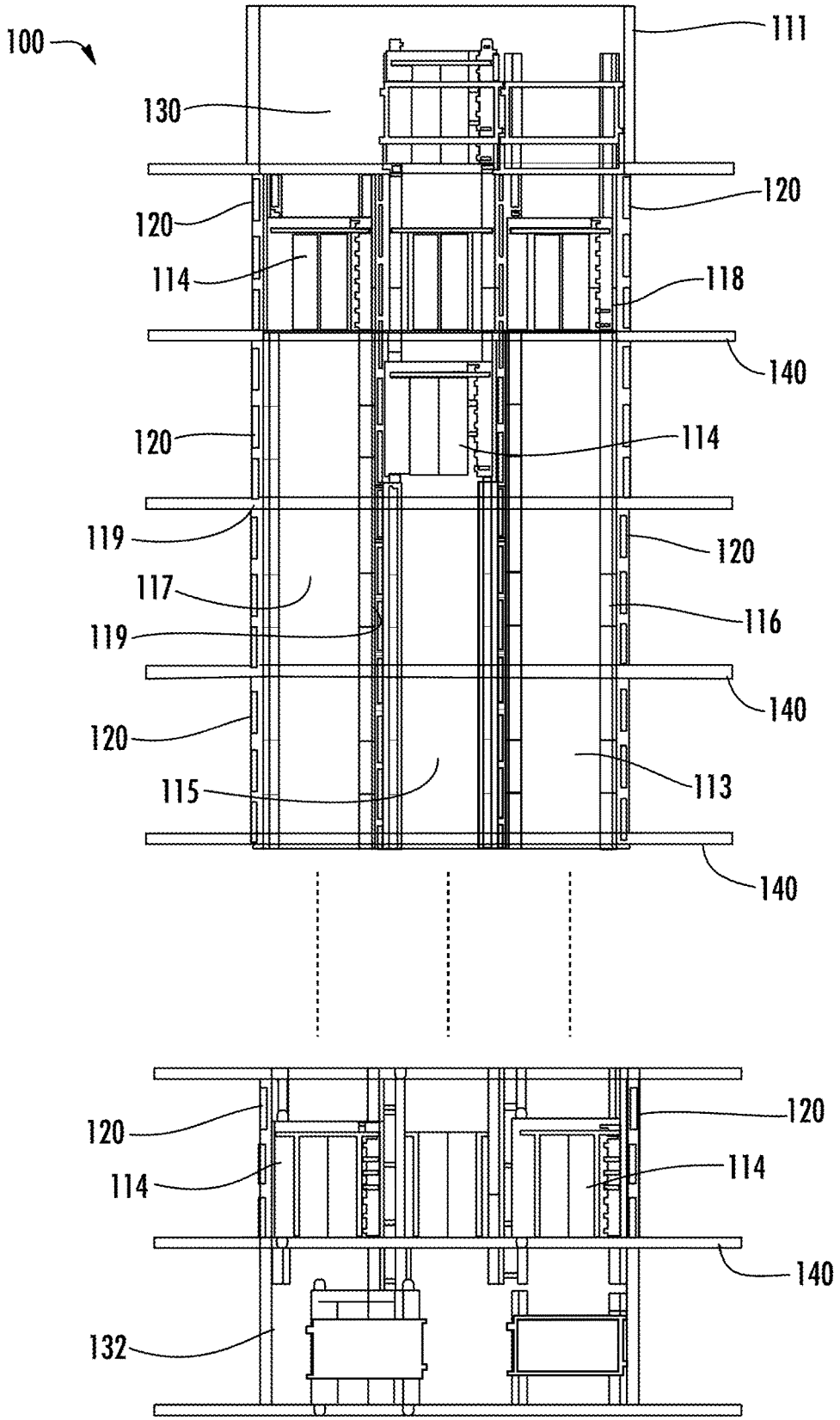
FIG. 1 depicts a multicar elevator system in an exemplary embodiment.

FIG. 1 depicts an exemplary multicar, ropeless elevator system 100 that may be employed with embodiments of the invention. Elevator system 100 includes an elevator shaft 111 having a plurality of lanes 113, 115 and 117. While three lanes 113, 115, 117 are shown in FIG. 1, it is understood that various embodiments of the invention and various configurations of a multicar, ropeless elevator system may include any number of lanes, either more or fewer than the three lanes shown in FIG. 1. In each lane 113, 115, 117, multiple elevator cars 114 can travel in one direction, i.e., up or down, or multiple cars within a single lane may be configured to move in opposite directions. For example, in FIG. 1 elevator cars 114 in lanes 113 and 115 travel up and elevator cars 114 in lane 117 travel down. Further, as shown in FIG. 1, one or more elevator cars 114 may travel in a single lane 113, 115, and 117.

As shown, above the top accessible floor of the building is an upper transfer station 130 configured to impart horizontal motion to the elevator cars 114 to move the elevator cars 114 between lanes 113, 115, and 117. It is understood that upper transfer station 130 may be located at the top floor, rather than above the top floor. Similarly, below the first floor of the building is a lower transfer station 132 configured to impart horizontal motion to the elevator cars 114 to move the elevator cars 114 between lanes 113, 115, and 117. It is understood that lower transfer station 132 may be located on the first floor, rather than below the first floor. Although not shown in FIG. 1, one or more intermediate transfer stations may be configured between the lower transfer station 132 and the upper transfer station 130. Intermediate transfer stations are similar to the upper transfer station 130 and lower transfer station 132 and are configured to impart horizontal motion to the elevator cars 114 at the respective transfer station, thus enabling transfer from one lane to another lane at an intermediary point within the elevator shaft 111. Further, although not shown in FIG. 1, the elevator cars 114 are configured to stop at a plurality of floors 140 to allow ingress to and egress from the elevator cars 114.

Elevator cars 114 are propelled within lanes 113, 115, 117 using a propulsion system such as a linear, permanent magnet motor system having a primary, fixed portion 116 and a secondary, moving portion 118. The primary portion 116 includes windings or coils mounted on a structural member 119, and may be mounted at one or both sides of the lanes 113, 115, and 117, relative to the elevator cars 114. Specifically, primary portions 116 will be located within the lanes 113, 115, 117, on walls or sides that do not include elevator doors.

The secondary portion 118 includes permanent magnets mounted to one or both sides of cars 114, i.e., on the same sides as the primary portion 116. The secondary portion 118 engages with the primary portion 116 to support and drive the elevators cars 114 within the lanes 113, 115, 117. Primary portion 116 is supplied with drive signals from one or more drive units 120 to control movement of elevator cars 114 in their respective lanes through the linear, permanent magnet motor system. The secondary portion 118 operatively connects with and electromagnetically operates with the primary portion 116 to be driven by the signals and electrical power. The driven secondary portion 118 enables the elevator cars 114 to move along the primary portion 116 and thus move within a lane 113, 115, and 117.

The primary portion 116, as shown in FIG. 1, is formed from a plurality of motor segments 122, with each segment associated with a drive unit 120. Although not shown, the central lane 115 of FIG. 1 also includes a drive unit for each segment of the primary portion 116 that is within the lane 115. Those of skill in the art will appreciate that although a drive unit 120 is provided for each motor segment 122 of the system (one-to-one) other configurations may be used without departing from the scope of the invention.

Figure 2:
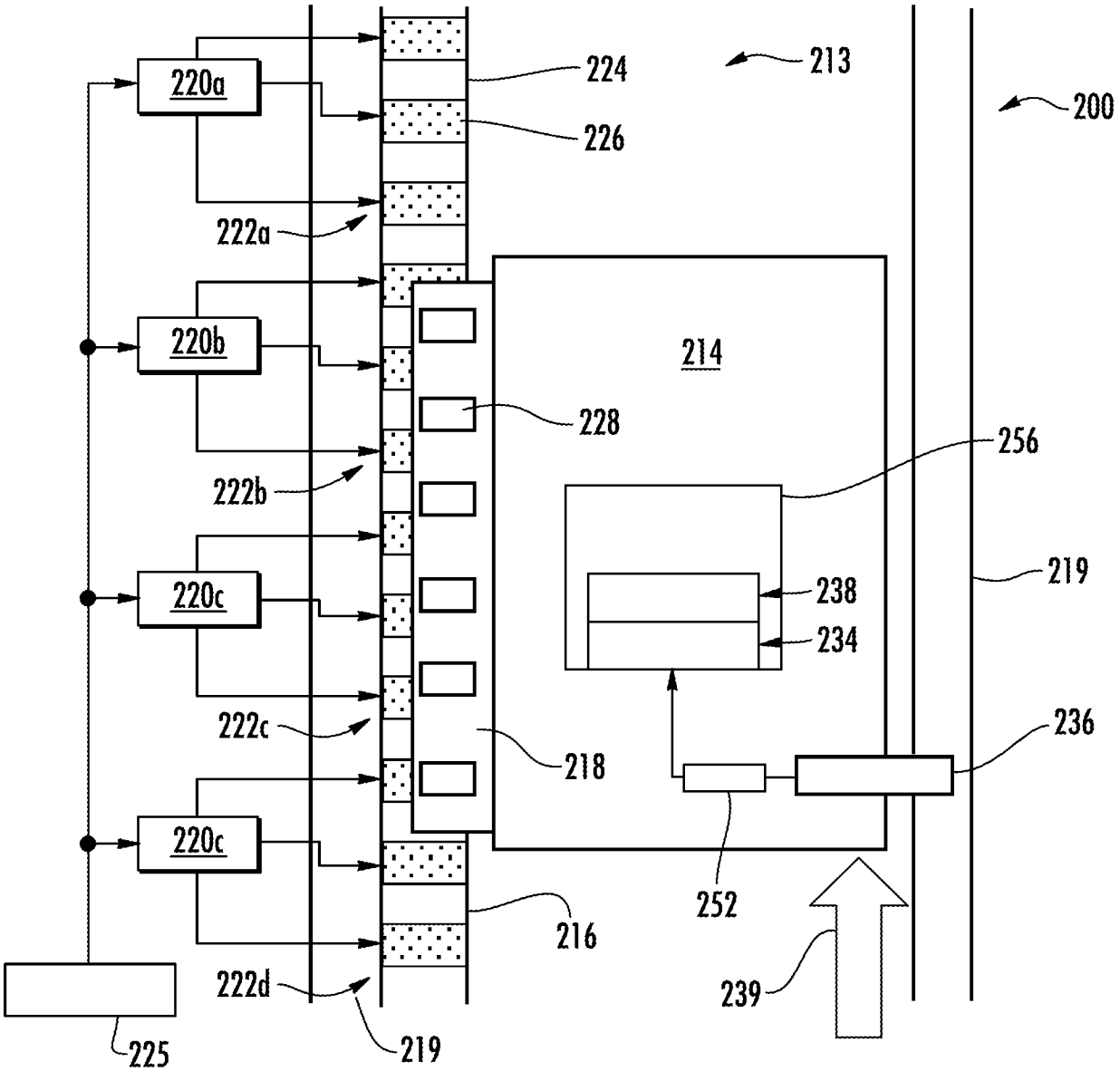
FIG. 2 depicts a single elevator car within a multicar elevator system in an exemplary embodiment.

Turning now to FIG. 2, a view of an elevator system 200 including an elevator car 214 that travels in lane 213 is shown. Elevator system 200 is substantially similar to elevator system 100 of FIG. 1 and thus like features are preceded by the number "2" rather than the number "1." Elevator car 214 is guided by one or more guide rails 224 extending along the length of lane 213, where the guide rails 224 may be affixed to a structural member 219. For ease of illustration, the view of FIG. 2 only depicts a single guide rail 224; however, there may be any number of guide rails positioned within the lane 213 and may, for example, be positioned on opposite sides of the elevator car 214. Elevator system 200 employs a linear propulsion system as described above, where a primary portion 216 includes multiple motor segments 222*a*, 222*b*, 222*c*, 222*d* each with one or more coils 226 (i.e., phase windings). The primary portion 216 may be mounted to guide rail 224, incorporated into the guide rail 224, or may be located apart from guide rail 224 on structural member 219. The primary portion 216 serves as a stator of a permanent magnet synchronous linear motor to impart force to elevator car 214. The secondary portion 218, as shown in FIG. 2, is mounted to the elevator car 214 and includes an array of one or more permanent magnets 228 to form a second portion of the linear propulsion system of the ropeless elevator system. Coils 226 of motor segments 222*a*, 222*b*, 222*c*, 222*d* may be arranged in three phases, as is known in the electric motor art. One or more primary portions 216 may be mounted in the lane 213, to coact with permanent magnets 228 mounted to elevator car 214. Although only a single side of elevator car 214 is shown with permanent magnets 228 the example of FIG. 2, the permanent magnets 228 may be positioned on two or more sides of elevator car 214. Alternate embodiments may use a single primary portion 216/secondary portion 218 configuration, or multiple primary portion 216/secondary portion 218 configurations.

In the example of FIG. 2, there are four motor segments 222*a*, 222*b*, 222*c*, 222*d* depicted. Each of the motor segments 222*a*, 222*b*, 222*c*, 222*d* has a corresponding or associated drive 220*a*, 220*b*, 220*c*, 220*d*. A system controller 225 provides drive signals to the motor segments 222*a*, 222*b*, 222*c*, 222*d* via drives 220*a*, 220*b*, 220*c*, 220*d* to control motion of the elevator car 214. The system controller 225 may be implemented using a microprocessor executing a computer program stored on a storage medium to perform the operations described herein. Alternatively, the system controller 225 may be implemented in hardware (e.g., ASIC, FPGA) or in a combination of hardware/software. The system controller 225 may also be part of an elevator control system. The system controller 225 may include power circuitry (e.g., an inverter or drive) to power the primary portion 216. Although a single system controller 225 is depicted, it will be understood by those of ordinary skill in the art that a plurality of system controllers may be used. For example, a single system controller may be provided to control the operation of a group of motor segments over a relatively short distance, and in some embodiments a single system controller may be provided for each drive unit or group of drive units, with the system controllers in communication with each other.

In some exemplary embodiments, as shown in FIG. 2, the elevator car 214 includes an on-board controller 256 with one or more transceivers 238 and a processor, or CPU, 234. The on-board controller 256 and the system controller 225 collectively form a control system where computational processing may be shifted between the on-board controller 256 and the system controller 225. In some exemplary embodiments, the processor 234 of on-board controller 256 is configured to monitor one or more sensors and to communicate with one or more system controllers 225 via the transceivers 238. In some exemplary embodiments, to ensure reliable communication, elevator car 214 may include at least two transceivers 238 configured for redundancy of communication. The transceivers 238 can be set to operate at different frequencies, or communication channels, to minimize interference and to provide full duplex communication between the elevator car 214 and the one or more system controllers 225. In the example of FIG. 2, the on-board controller 256 interfaces with a load sensor 252 to detect an elevator load on a brake 236. The brake 236 may engage with the structural member 219, a guide rail 224, or other structure in the lane 213. Although the example of FIG. 2 depicts only a single load sensor 252 and brake 236, elevator car 214 can include multiple load sensors 252 and brakes 236.

In order to drive the elevator car 214, one or more motor segments 222*a*, 222*b*, 222*c*, 222*d* can be configured to overlap the secondary portion 218 of the elevator car 214 at any given point in time. In the example of FIG. 2, motor segment 222*d* partially overlaps the secondary portion 218 (e.g., about 33% overlap), motor segment 222*c* fully overlaps the secondary portion 218 (100% overlap), and motor segment 222*d* partially overlaps the secondary portion 218 (e.g., about 66% overlap). There is no depicted overlap between motor segment 222*a* and the secondary portion 218. In some embodiments, the control system (system controller 225 and on-board controller 256) is operable to apply an electrical current to at least one of the motor segments 222*b*, 222*c*, 222*d* that overlaps the secondary portion 218. The system controller 225 can control the electrical current on one or more of the drive units 220*a*, 220*b*, 220*c*, 220*d* while receiving data from the on-board controller 256 via transceiver 238 based on load sensor 252. The electrical current may apply an upward thrust force 239 to the elevator car 214 by injecting a constant current, thus propelling the elevator car 214 within the lane 213. The thrust produced by the linear propulsion system is dependent, in part, on the amount of overlap between the primary portion 216 with the secondary portion 218. The peak thrust is obtained when there is maximum overlap of the primary portion 216 and the secondary portion 218.

Figure 3:
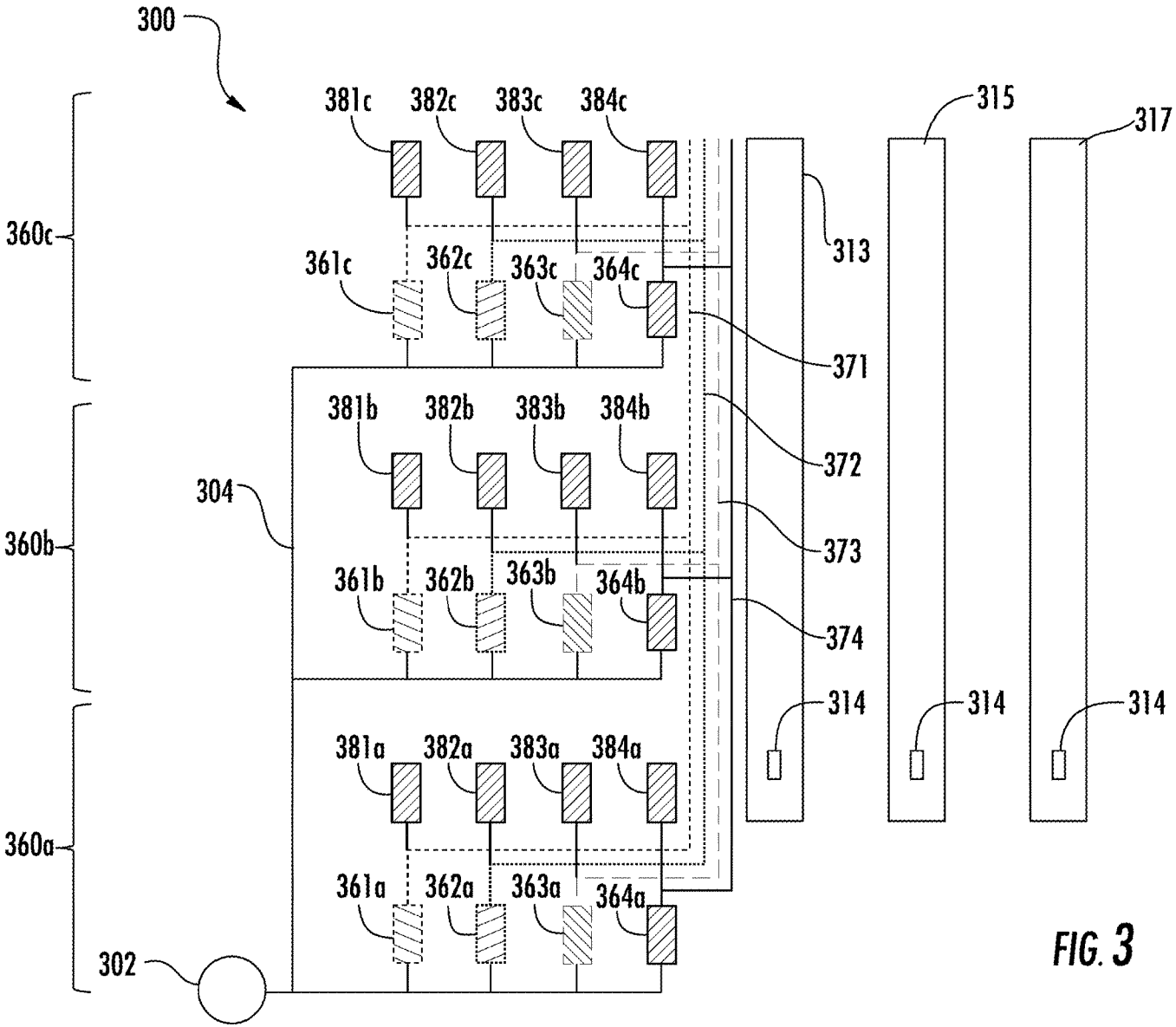
FIG. 3 depicts a schematic block diagram of a power distribution system in accordance with a first exemplary embodiment.

Turning now to FIG. 3, a first exemplary embodiment of the invention is shown. Power distribution system 300 is configured as part of an elevator system, such as described above with respect to FIGS. 1 and 2. Electrical power is provided through power distribution system 300 to provide the electrical power that enables propulsion of the elevator cars within a multicar, ropeless elevator system. In typical building power distribution systems, AC power from the grid is fed to various loads throughout the building using an AC feeder distribution. The loads are localized and this approach provides power directly and efficiently to the various loads. For multicar elevator systems, individual elevator cars are distributed throughout the building (and within the lanes) based on the dispatching and load pattern and as a result a power distribution scheme is needed to efficiently provide power to the various elevator cars.

In FIG. 3, the power distribution system 300 of an exemplary embodiment is configured to provide a continuous DC power distribution system to various cars in a multicar elevator system. As shown in FIG. 3, a plurality of lanes 313, 315, 317, are shown. Each lane 313, 315, 317 may include one or more elevator cars 314 therein. Further, each lane 313, 315, 317 will be configured with a power distribution system as described herein, to enable power supply to each and every car that is within a building.

AC power from the grid 302 is provided through power lines 304 to various service floors 360*a*, 360*b*, 360*c* and converted to DC power through rectifiers. As used herein, rectifies refers to any device configured to convert AC power to DC power. Thus, although the term rectifier is used throughout this description, those of skill in the art will appreciate that other configurations and/or device may be used without departing from the scope of the invention. Specifically, the term rectifier, as used herein, encompasses any device or process that converts AC power to DC power. As such, in some embodiments the rectifier may be configured as part of another device rather than a separate device, as shown in some of the embodiments disclosed herein.

Each service floor 360*a*, 360*b*, 360*c* has an associated set of rectifiers, such that rectifiers 361*a*, 362*a*, 363*a*, 364*a* are located on a first service floor 360*a*; rectifiers 361*b*, 362*b*, 363*b*, 364*b* are located on a second service floor 360*b*; and rectifiers 361*c*, 362*c*, 363*c*, 364*c* are located on a third service floor 360*c*. The set of rectifiers on each floor are provided for redundancy and fault management. Those of skill in the art will appreciate that although FIG. 3 shows three service floors, with four rectifiers at each floor, these numbers are not limiting and more or fewer floors may be employed in the power distribution system and more or fewer rectifiers may be used, without departing from the scope of the invention.

The power distribution system 300 is configured with multiple DC buses per group of lanes (313, 315, 317). Thus, as shown in FIG. 3, four DC buses (371, 372, 373, 374) are provided per group of lanes (313, 315, 317). A first bus 371 is electrically connected to rectifiers 361*a*, 361*b*, 361*c* and runs the length of the lanes 313, 315, 317. A second bus 372 is electrically connected to rectifiers 362*a*, 362*b*, 362*c* and runs the length of the lanes 313, 315, 317. A third bus 373 is electrically connected to rectifiers 363*a*, 363*b*, 363*c* and runs the length of the lanes 313, 315, 317. A fourth bus 374 is electrically connected to rectifiers 364*a*, 364*b*, 364*c* and runs the length of the lanes 313, 315, 317. Thus, the buses 371, 372, 373, 374 are configured as uninterrupted cables, wires, or power lines that provide a continuous power feed for the length of the lane.

Those of ordinary skill in the art will appreciate that the number of buses is variable, adjustable, or changeable, but typically the number of buses would need to be greater than one for adequate fault management and redundancy. To generate each DC bus 371, 372, 373, 374 an associated rectifier or group of rectifiers (as described above) is used and energy storage or battery backup 381*a*, 382*a*, 383*a*, 384*a*, etc., is attached to each rectifier to provide power when the grid fails or as other emergency and/or excess/additional power source and/or as a power storage medium/location. Each of the DC buses 371, 372, 373, 374 runs along the lanes 313, 315, 317 and various drives are connected to the DC bus, as described with respect to FIG. 2. The drives are used to power or control the various elevator cars 314 and provide adequate thrust and/or control.

Depending on the direction of movement of the elevator cars 314 the drives could be either sourcing or sinking power in to the DC bus system, e.g., if an elevator car 314 is moving downward and braking, power may be sourced and extracted from the system such as to recharge the associated backup battery (381*a*, 382*a*, 383*a*, 384*a*, etc.), or if the elevator car 314 is moving upward, power is provided to the associated bus from the grid or from battery backups. The presence of a continuous DC bus as shown in FIG. 3 enables the distribution system to easily share power between various elevator cars 314 located in different parts of the lanes 313, 315, 317. For example, if a first elevator car in a lane is being propelled upward, and if a second elevator car is braking and moving downward, the power gained from regenerative braking of the second elevator car can be redistributed to be used to propel or power the first elevator car. In some such embodiments, regenerative power can be transferred from a bus, through a rectifier, into the power line of the system (AC side) then to another rectifier, and into another bus. Further, in some such embodiments, if a first elevator car is traveling upward in a lane and a second elevator car is traveling downward in the same lane, power may not need to travel through the rectifiers, and thus no conversion of AC/DC power is required, providing an additional efficiency to the system. In some embodiments, the various DC buses 371, 372, 373, 374 could have series devices electrically connected thereto to provide disconnect mechanisms in case of a fault, such as circuit breakers, contactors, etc.

The battery backup 381*a*, 382*a*, 383*a*, 384*a*, etc., as shown in FIG. 3, can be used to provide power to the elevator system in the event of a power failure from the grid supply 302 and/or provide power storage or supply for other reasons. The battery backup 381*a*, 382*a*, 383*a*, 384*a*, etc. at each service floor, and located with each rectifier 361*a*, 362*a*, 363*a*, 364*a*, provides emergency power to the system. Further, each battery backup 381*a*, 382*a*, 383*a*, 384*a*, etc., as noted above, can be recharged through regenerative braking of the elevator cars 314. In the embodiment and configuration of FIG. 3, the power from the battery backup that is configured for one bus may be transmitted through the associated rectifier, back into the wiring 304, and provided to another battery backup or to another rectifier and/or bus. For example, power may be extracted from battery backup 381*a*, converted in rectifier 361*a*, conveyed through wiring 304 to rectifier 364*b*, and sourced into either battery backup 384*b* or bus 371. Accordingly, in some embodiments, the rectifiers employed by embodiments of the invention are bi-directional, and can be used to provide energy back to the grid 302 or to other components of the system 300. Furthermore, in some embodiments, with a continuous bus extending the length of a lane, power can be transferred within that lane. For example, if a first elevator car in a lane is braking and thus generating power, that generated power can be transferred through the bus in which it is generated to another elevator in the same lane, without requiring the power to leave the lane, or even the bus.

Figure 4:
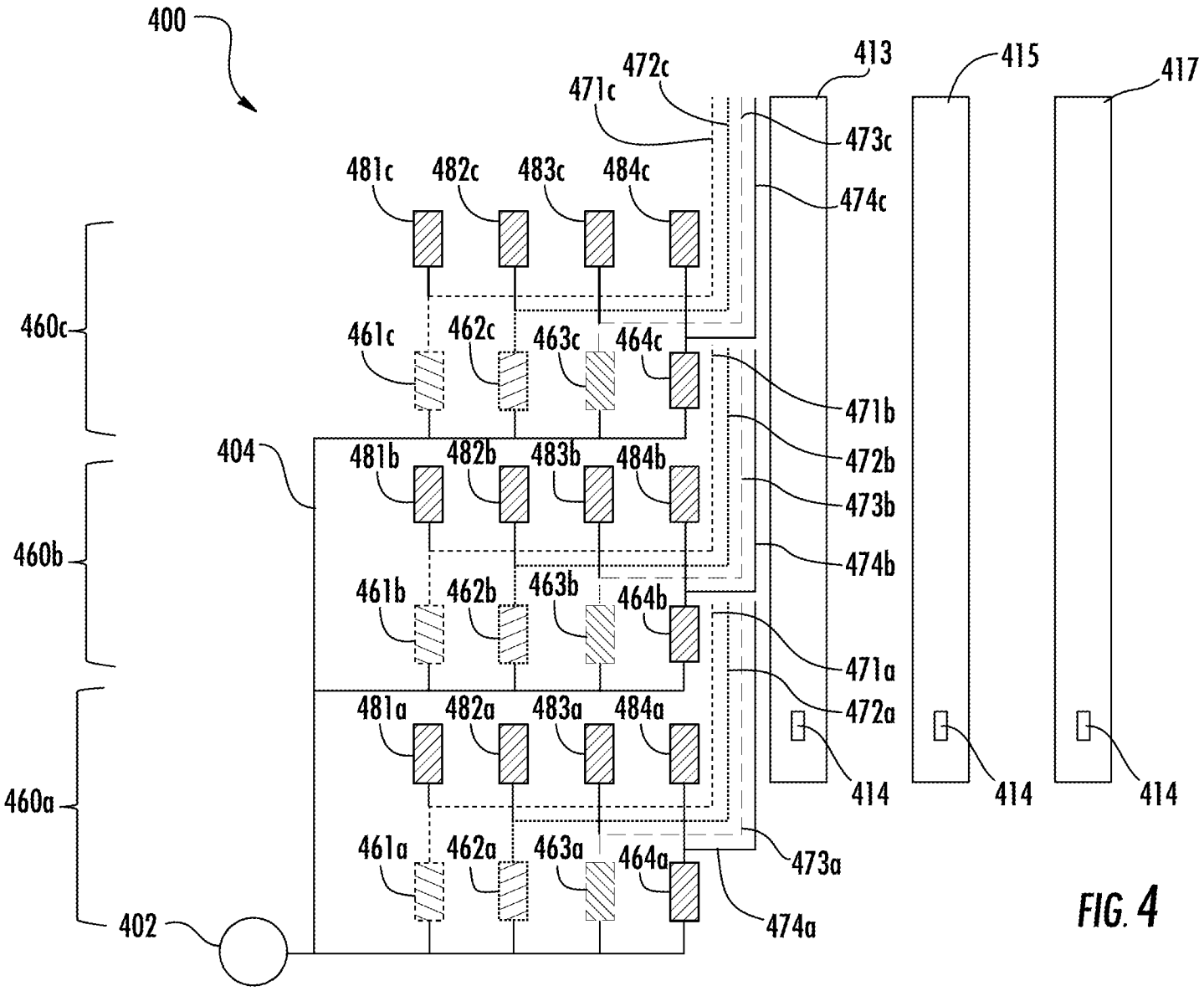
FIG. 4 depicts a schematic block diagram of a power distribution system in accordance with a second exemplary embodiment.

Turning now to FIG. 4, a second exemplary embodiment of the invention is shown. In FIG. 4, some features are substantially similar to the features of FIG. 3, and thus like features will be represented with similar reference numbers, but preceded by a "4" rather than a "3." Thus, power from grid 402 is provided through power lines 404 to a plurality of service floors 460*a*, 460*b*, 460*c*. Rectifiers 461*a*, 462*a*, 463*a*, 464*a*, etc. are provided to convert AC power to DC power, and battery backups 481*a*, 482*a*, 483*a*, 484*a*, etc. are provided for additional power and/or emergency power, as shown and labeled. The primary difference between power distribution system 400 and power distribution system 300 of FIG. 3 is the configuration of the buses. In FIG. 3, buses 371, 372, 373, 374 were continuous, uninterrupted electrical power lines. In contrast, buses 471, 472, 473, 474 are segmented into a zoned power distribution system. Thus, each set of rectifiers and battery backups are configured with an associated zone or bus segment 471*a*, 471*b*, 471*c*, etc., as shown in FIG. 4, and for each zone or segment there are multiple buses 471*a*, 472*a*, 473*a*, 474*a*. Each zone or bus segment 471*a*, 471*b*, 471*c* is configured with a zone that is defined, in part, by the respective service floors 460*a*, 460*b*, 460*c*, and may span a plurality of floors that is a subset of the total number of floors that are in the building. Thus, the buses do not span the entire length of the lanes, but rather provide power to a subset or segment of the lanes.

In embodiments that include zones or segments, power may be transferred between different buses and different zones. For example, in these configurations, power may be converted in rectifiers multiple times in order to reach the desired bus, battery backup, or location. Thus, embodiments configured with zones may operate substantially similar to the continuous bus configuration shown in FIG. 3.

Figure 5:
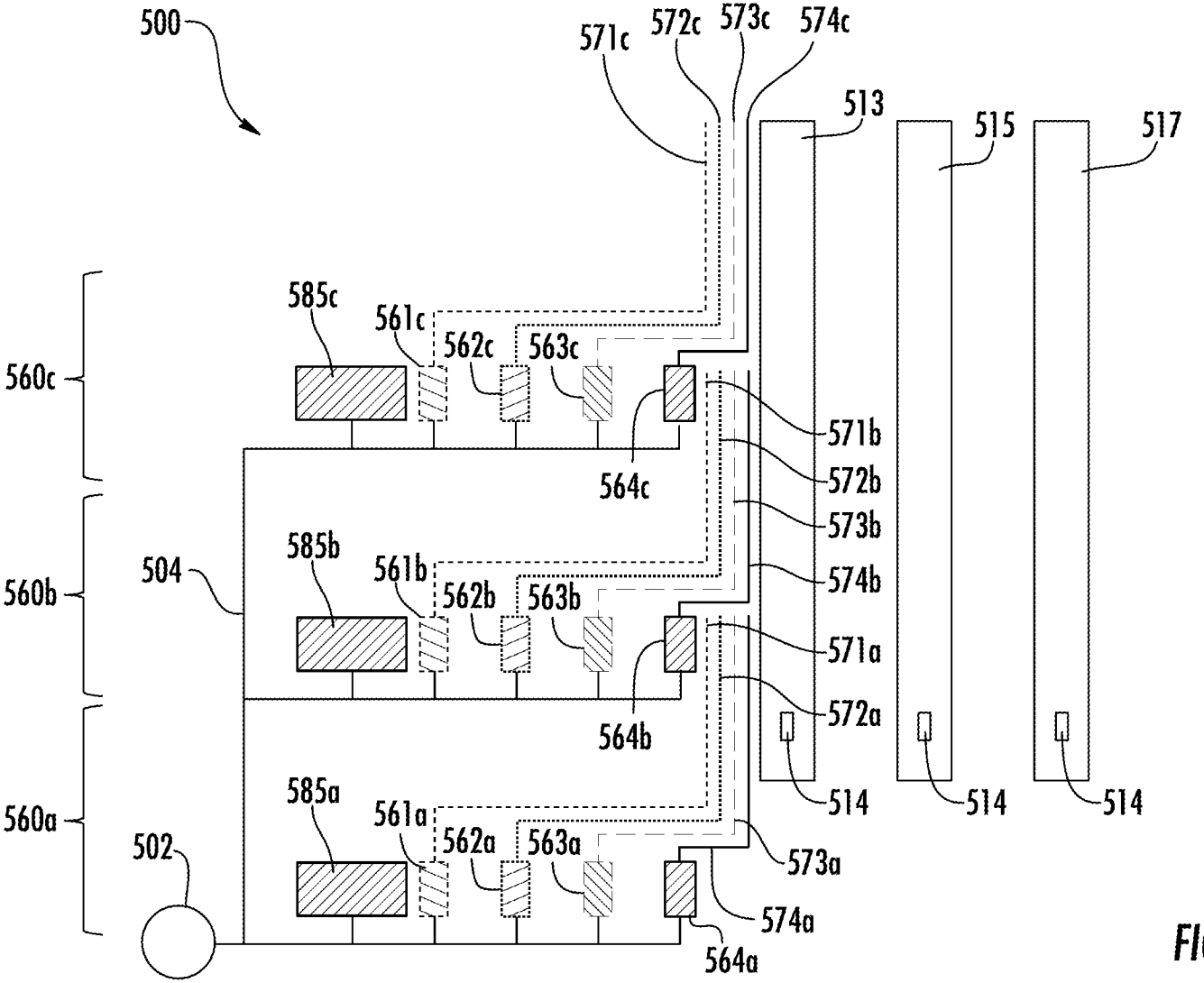
FIG. 5 depicts a schematic block diagram of a power distribution system in accordance with a third exemplary embodiment.

Turning now to FIG. 5, a third exemplary embodiment of the invention is shown. In FIG. 5, some features are substantially similar to the features of FIGS. 3 and 4, and thus like features will be represented with similar reference numbers, but preceded by a "5" rather than a "3" or "4," respectively. As such, power from grid 502 is provided through power lines 504 to a plurality of service floors 560*a*, 560*b*, 560*c*. Rectifiers 561*a*, 562*a*, 563*a*, 564*a*, etc. are provided to convert AC power to DC power and provide power to segmented or zoned buses 571, 572, 573, 574, similar to the configuration of FIG. 4. The primary difference between power distribution system 500 and power distribution systems 300 of FIG. 3 and 400 of FIG. 4 is the configuration of the battery backups. In FIGS. 3 and 4, a single battery backup is provided for each rectifier of the system. In contrast, in FIG. 5, one battery backup 585*a*, 585*b*, 585*c* is provided for each service floor 560*a*, 560*b*, 560*c*, respectively, or one per segment/zone. For example, as shown, battery backup 585*a* is electrically connected to the group of rectifiers 561*a*, 562*a*, 563*a*, 564*a* and associated buses 571*a*, 572*a*, 573*a*, 574*a*. Thus, each set of rectifiers and buses are configured with an associated single battery backup, as shown in FIG. 5. Similar to the second embodiment of FIG. 4, each bus segment 571*a*, 571*b*, 571*c* is configured with zones that are defined, in part, by the respective service floors 560*a*, 560*b*, 560*c*, and may span a plurality of floors that is a subset of the total number of floors that are in the building. Thus, the buses do not span the entire length of the lanes, but rather provide power to a subset or segment of the lanes.

In the third embodiment, battery backups 585*a*, 585*b*, 585*c* are placed on the AC side of the rectifiers. The battery backups 585*a*, 585*b*, 585*c* are centralized and thus provide an energy sharing mechanism between various DC buses in a zone. The zoned DC bus scheme forces the regeneration energy from elevator car braking to be absorbed by the battery backup and zone-to-zone sharing occurs through the rectifiers. Advantageously, similar to the second embodiment, this zoned scheme may limit DC bus fault effects to a smaller section and contain feeder damage in the event of a fault. The presence of a centralized battery system, as shown in FIG. 5, enables the system to work in a fashion similar to a UPS (uninterruptible power supply) based elevator system.

In accordance with the various exemplary embodiments described above, the power control distribution described herein may be controlled by a central processor or computer. In some embodiments, the power distribution is controlled by a control system that operates and manages the entire elevator system. In some alternative embodiments, the power distribution control may be configured as a component that is separate from other controls for the elevator system.

Advantageously, various embodiments of the invention provide a reliable and efficient power distribution system for a multicar elevator system. In some embodiments, the presence of multiple DC buses enables fault management, redundancy, and continued operation in the event of a drive or DC bus failure. In some embodiments, the use of battery backups enables the system to safely stop elevator cars in an emergency situation, such as when building power loss occurs. In some embodiments, the zoned DC bus system limits the fault current from a DC bus short circuit failure to a limited area, e.g., to a single zone or segment. The zoning configurations enable the rest of the system to work during a fault of one bus or system component with no loss in performance. In some embodiments, with centralized battery storage, the sharing of energy from one zone to another zone is efficiently managed. In view of the above, advantageously, embodiments of the invention provide a safe and efficient power distribution system for a multicar elevator system.

Further, advantageously, because of the multiple bus configuration, regardless of a zoned or continuous bus configuration, the system can be configured to be substantially and/or essentially self-sufficient. For example, with the use of battery backups and regenerative braking and power storage in the battery backups, the system can rely on the power provided from these two sources and operate completely independently from the grid. Further, advantageously, because of the use of multiple buses, regenerative braking may provide excess energy and/or power that could be fed back to the grid, used to drive and/or power other elevator cars within the system, power other portions of the building, and/or be stored within the battery backup systems of the power distribution system.

Moreover, advantageously, embodiments of the invention provide a distributed, redundant, and regenerative power distribution system that is efficient and safe.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments and/or features.

For example, although described herein as a conversion from AC to DC power for driving elevator cars, those of skill in the art will appreciate that AC power may be used, and battery backup systems may still be employed in accordance with embodiments of the invention. Further, in some embodiments, the service floors described herein that provide the power distribution systems of the invention may be located approximately every 20 floors within a building. However, those of skill in the art will appreciate that the distribution and configuration of these systems may vary and the floor distribution is not limiting herein. Further, although described with respect to application at service floors within a building, this is merely provided for exemplary and explanatory purposes and those of skill in the art will appreciate that the systems may be employed on any floor of a building, without departing from the scope of the invention.

Further, although described herein with four buses, and at each floor four rectifiers, with potentially four associated battery backups, those skilled in the art will appreciated that these numbers are not limiting and any number and configuration of the various component parts of the invention may be used without departing from the scope of the invention. Further, although described herein as the first embodiment having a continuous bus and the other embodiments having segmented buses, those of skill in the art will appreciate that known mechanisms are available such that a building configured with a single continuous bus system could have electrical components included to create a segmented or zoned configuration.

Accordingly, the invention is not to be seen as limited by the foregoing description, but is only limited by the scope of the appended claims.

What is claimed is:

1. An elevator power distribution system comprising:

an elevator car configured to travel in a lane of an elevator shaft;

a linear propulsion system configured to impart force to the elevator car, the linear propulsion system comprising:

a first portion mounted in the lane of the elevator shaft; and a second portion mounted to the elevator car configured to coact with the first portion to impart movement to the elevator car;

a plurality of electrical buses disposed within the lane and configured to provide power to the first portion of the linear propulsion system;

a rectifier electrically connected to each of the plurality of electrical buses and configured to convert power provided between a respective electrical bus and a grid; and a battery backup electrically connected with the rectifier and configured to transfer power to or receive power from the rectifier.

2. The power distribution system of claim 1, wherein each of the plurality of electrical buses is a continuous, uninterrupted power line extending the length of the lane.

3. The power distribution system of claim 1, wherein a plurality of pairs of rectifiers and battery backups are provided in electrical communication with each of the plurality of electrical buses.

4. The power distribution system of claim 1, further comprising one or more circuit breakers configured to split each of the plurality of electrical buses into two or more segmented zones.

5. The power distribution system of claim 1, wherein a single battery backup is configured in electrical communication with a plurality of rectifiers.

6. The power distribution system of claim 1, wherein each of the plurality of electrical buses is composed of a plurality of zones.

7. The power distribution system of claim 6, wherein a plurality of pairs of rectifiers and battery backups are provided in electrical communication with each of the zones of the plurality of electrical buses.

8. The power distribution system of claim 6, wherein each zone of the plurality of electrical buses includes a single battery backup and a plurality of rectifiers in electrical communication therewith.

9. The power distribution system of claim 1, further comprising one or more additional elevator cars, the power distribution system configured to supply power to and receive power from at least one of the elevator car and the one or more additional elevator cars.

10. The power distribution system of claim 1, wherein the plurality of electrical buses is at least three electrical buses.

11. A method of power distribution comprising:

providing a plurality of electrical buses configured to provide power to a linear propulsion system;

converting power (i) received from a grid and providing it to at least one of the plurality of electrical buses and (ii) received from at least one of the plurality of electrical buses and providing to at least one of the grid and a battery backup; and transferring power from one of the plurality of electrical buses to another of the plurality of electrical buses to supply power thereto.

12. The method of claim 11, wherein each of the plurality of electrical buses is a continuous, uninterrupted power line extending the length of a lane of an elevator shaft.

13. The method of claim 11, wherein a plurality of pairs of rectifiers and battery backups are provided in electrical communication with each of the plurality of electrical buses.

14. The method of any of claim 11, wherein each of the plurality of electrical buses is configured to be split into two or more segmented zones.

15. The method of claim 11, wherein each of the plurality of electrical buses is composed of a plurality of zones.

16. The method of claim 15, wherein a plurality of pairs of rectifiers and battery backups are provided in electrical communication with each of the zones of the plurality of electrical buses.

17. The method of claim 15, wherein each zone of the plurality of electrical buses includes a single battery backup and a plurality of rectifiers in electrical communication therewith.

18. The method of claim 11, wherein each of the plurality of electrical buses are segmented into power distribution zones.

19. The power distribution system of claim 1, wherein each of the plurality of electrical buses are segmented into power distribution zones.

* * * * *